United States Patent [19]

Brois

[11] 4,035,309

[45] July 12, 1977

[54] METAL-CONTAINING OXAZOLINE ADDITIVES AND LUBRICATING OILS CONTAINING SAID ADDITIVES

[75] Inventor: Stanley J. Brois, Wantage, England

[73] Assignee: Exxon Research and Engineering Company, Linden, N.J.

[21] Appl. No.: 561,202

[22] Filed: Mar. 24, 1975

[51] Int. Cl.[2] ..... C10M 1/10

[52] U.S. Cl. ..... 252/49.7; 252/51.5 A; 252/51.5 R; 260/307 R; 260/307 F

[58] Field of Search ..... 252/51.5 R, 51.5 A, 252/49.7; 260/307 R, 307 F

[56] References Cited

U.S. PATENT DOCUMENTS

| | | | |
|---|---|---|---|
| 2,402,198 | 6/1946 | Loder | 260/307 F X |
| 2,402,791 | 6/1946 | Wampner | 260/307 F X |
| 2,450,806 | 10/1948 | McCarthy | 252/49.7 X |
| 2,450,807 | 10/1948 | McCarthy | 252/49.7 X |
| 2,569,428 | 9/1951 | Rowland | 260/307 F |
| 2,759,894 | 8/1956 | Matuszak | 260/307 F X |
| 2,905,644 | 9/1959 | Butter | 252/51.5 R X |
| 2,924,571 | 2/1960 | Hughes | 260/307 F X |
| 3,741,961 | 6/1973 | Kmiecik et al. | 260/307 F X |
| 3,824,248 | 7/1974 | Mileo et al. | 200/307 F |

FOREIGN PATENT DOCUMENTS

| | | | |
|---|---|---|---|
| 1,444,904 | 2/1909 | Germany | 252/51.5 A |

*Primary Examiner*—Delbert E. Gantz
*Assistant Examiner*—Andrew H. Metz
*Attorney, Agent, or Firm*—Roland A. Dexter

[57] ABSTRACT

Metal-containing oxazoline products from the metal salt (e.g. zinc acetate) promoted reaction of hydrocarbon substituted dicarboxylic acid material, for example, polyisobutenyl-succinic anhydride, with a 2,2-disubstituted-2-amino-1-alkanol, such as tris-hydroxymethylaminomethane (THAM) are useful additives in oleaginous compositions, such as sludge dispersants for lubricating oil or gasoline.

10 Claims, No Drawings

METAL-CONTAINING OXAZOLINE ADDITIVES AND LUBRICATING OILS CONTAINING SAID ADDITIVES

BACKGROUND OF THE INVENTION AND PRIOR ART

During the past decade, ashless sludge dispersants have become increasingly important, primarily in improving the performance of lubricants and gasoline in keeping the engine clean of deposits, and permitting extended crankcase oil drain periods. Most commercial ashless dispersants fall into several general categories. In one category, an amine or polyamine is attached to a long chain hydrocarbon polymer, usually polyisobutylene, obtained by the reaction of halogenated olefin polymer with polyamine as in U.S. Pat. Nos. 3,275,554; 3,565,592; 3,565,804. In another category, a polyamine is linked to the polyisobutylene through an acid group, such as long chain monocarboxylic acid, e.g., see U.S. Pat. No. 3,444,170 or long chain dicarboxylic acid such as polyisobutenylsuccinic anhydride, by forming amide or imide linkages, such as described in U.S. Pat. Nos. 3,172,892; 3,219,666; etc. More recently, non-nitrogen ashless dispersants have been formed by esterifying long chain dicarboxylic acids; such as the polyisobutenylsuccinic anhydride, with polyols, such as pentaerythritol, as in U.S. Pat. No. 3,381,002.

Reaction products of hydrocarbon substituted succinic anhydride, e.g., the aforesaid polyisobutenylsuccinic anhydride, with compounds containing both an amine group and a hydroxy group have been suggested or investigated in the prior art. For example, U.S. Pat. No. 3,272,746 teaches the reaction of ethanolamine and diethanolamine, as well as various hydroxyalkyl substituted alkylene amines, such as N-(2-hydroxyethyl) ethylene diamine, N,N'-bis(2-hydroxyethyl) ethylene diamine, with alkenyl succinic anhydride to obtain ashless dispersants for lube oil. A hydroxy amine, such as diethanolamine, is reacted with a long chain alkenylsuccinic and amides, wherein some of the diethanolamine reacts through a hydroxy group to give an ester linkage, while another portion of the diethanolamine forms an amide linkage. U.S. Pat. No. 3,364,001 teaches a tertiary alkanolamine reacted with an alkenyl succinic anhydride to form an ester useful as a gasoline additive. U.S. Pat. No. 3,448,049 teaches dispersants, corrosion inhibitors and antiwear agents in lubricants and fuels by esterifying alkenylsuccinic anhydride with a hydroxy compound made by reacting an alkanolamine with an unsaturated ester, amide or nitrile. U.S. Pat. No. 3,630,904 teaches reacting a hydroxy amine, with both short and long chain dicarboxylic acid. U.S. Pat. No. 3,484,374 teaches the polymeric condensation products of polycarboxylic acid or anhydride with various alkanolamines such as aminoethylethanolamine, N-methyldiethanolamine, etc. United Kingdom specification 809,001 teaches corrosion inhibitors comprising a multiple salt complex derived from the reaction product of hydrocarbyl substituted dicarboxylic acids and hydroxy amines (including 2-amino-2-methyl-1,3-propanediol [AMP] and trishydroxymethylaminomethane [THAM] further complexed with mono- and polycarboxylic acids (see Examples 17–19).

U.S. Pat. No. 3,576,743 teaches reacting polyisobutenylsuccinic anhydride with a polyol, such as pentaerythritol, followed by reaction with THAM, (see Example 4). U.S. Pat. No. 3,632,511 teaches reacting polyisobutenylsuccinic anhydride with both a polyamine and a polyhydric alcohol including THAM. U.S. Pat. No. 3,697,428 (Example 11) teaches reacting polyisobutenylsuccinic anhydride with a mixture of pentaerythritol and THAM. United Kingdom Specification 984,409 teaches ashless, amide/imide/ester type lubricant additives prepared by reacting an alkenylsuccinic anhydride, said alkenyl group having 30 to 700 carbon atoms, with a hydroxy amine including THAM.

SUMMARY OF THE INVENTION

As noted above, the prior art teaches dispersants formed from hydrocarbyl substituted dicarboxylic acid material, usually alkenyl succinic anhydride, reacted with various amino or hydroxy compounds either through an amide, imide or ester linkage. In contrast thereto, two copending U.S. patent applications Ser. No. 455,250, filed Mar. 27, 1974, now abandoned and refiled as U.S. patent application Ser. No. 708,925, filed July 27, 1976 and Ser. No. 530,235 filed Dec. 6, 1974, now abandoned and refiled as U.S. patent application Ser. No. 710,279, filed July 30, 1976 are based upon the discovery that the reaction of a hydrocarbyl dicarboxylic acid material, i.e. acid or anhydride, or ester, with certain classes of amino alcohols, under certain conditions, will result in products containing a heterocyclic ring structure, namely an oxazoline ring, and that materials with this oxazoline ring can be tailored for various functions, such as anti-rust agents, detergents, or dispersants for oleaginous compositions including lube oil, gasoline, turbine oils and oils for drilling applications.

The metal-containing products of the reaction to which the invention herein is applicable having a substantially saturated aliphatic hydrocarbyl group and at least one carboxylic acid group converted into an oxazoline ring as a result of the reaction of at least equimolar equivalent amounts of said hydrocarbon substituted $C_4$–$C_{10}$ mono-unsaturated dicarboxylic acid material and a 2,2-disubstituted-2-amino-1-alkanol having 2 to 3 hydroxy groups and containing a total of 4 to 8 carbons, said reaction being promoted with a metal salt, e.g., zinc acetate. The reaction products usefully have number average molecular weights ($M_n$) as determined by vapor phase osmometry of from about 200 to 5000, preferably from about 500 to 3000.

The present invention is based upon the discoveries that: (1) the aforesaid reaction of hydrocarbyl dicarboxylic acid material with certain classes of amino alcohols to produce oxazoline ring compounds can be promoted by conducting the reaction in the presence of a metal salt or oxide, preferably a zinc carboxylate or oxide; and, (2) the zinc-containing oxazoline products have been found to be highly effective additives.

DETAILED DESCRIPTION OF THE INVENTION

The hydrocarbyl substituted dicarboxylic acid material, i.e., acid or anhydride, or ester includes alpha-beta unsaturated $C_4$ to $C_{10}$ dicarboxylic acid, or anhydrides or esters thereof, such as fumaric acid, itaconic acid, maleic acid, maleic anhydride, chloromaleic acid, dimethyl fumarate, etc., which are substituted with a hydrocarbyl group, usefully a hydrocarbon chain containing at least 8 carbons (branched or unbranched) and includes long hydrocarbon chains, generally an olefin polymer chain.

In general, these hydrocarbyl substituted dicarboxylic acid materials and their preparation are well known in the art, for example see U.S. Pat. No. 3,219,666; 3,172,892; 3,272,746; the aforementioned prior art patents; as well as several being commercially available, e.g., 2-octadecenylsuccinic anhydride and polyisobutylene succinic anhydride.

The hydrocarbyl portion optionally should average at least 30 aliphatic carbon atoms per dicarboxylic acid group and be substantially saturated. Usually no more than 10 mole %, and preferably 5 mole % or less of the total carbon to carbon linkage will be unsaturated, as excessive unsaturation in the final product will tend to oxidize and unduly form gums and resins in the engine. Further descriptions and examples of the hydrocarbyl substituent portion are set forth in the referenced copending U.S. patent application, Ser. No. 455,250, filed Mar. 27, 1974; and Ser. No. 530,235 filed Dec. 6, 1974; which are hereby incorporated in this application by reference thereto.

Frequently these hydrocarbyl substituted dicarboxylic acid materials are prepared by reacting the unsaturated dicarboxylic acid material, usually maleic anhydride, with a 1-olefin, e.g. an olefin polymer of at least 30 carbons still retaining a terminal unsaturation which hereafter is characterized as a thermal hydrocarbyl substituted dicarboxylic acid material; a preferred material.

THE AMINO ALCOHOL

The amino alcohol used to make the oxazoline reaction product is a 2,2-disubstituted-2-amino-1-alkanol, having 2 to 3 hydroxy groups, containing a total of 4 to 8 carbon atoms, and which can be represented by the formula:

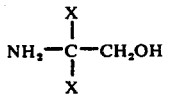

wherein X is an alkyl, or hydroxy alkyl group, with at least one of the X substituents, and preferably both of the X substituents being a hydroxy alkyl group of the structure $-(CH_2)_nOH$, wherein $n$ is 1 to 3.

Examples of such 2,2-disubstituted amino alkanols, include 2-amino-2-methyl-1,3-propanediol, 2-amino-2-(hydroxymethyl)-1,3-propanediol (also known as tris-hydroxyaminomethane or THAM), 2-amino-2-ethyl-1,3-propanediol, etc. Because of its effectiveness, availability, and cost, the THAM is particularly preferred.

THE OXAZOLINE REACTION CONDITIONS

The formation of the novel oxazoline dispersants in high yield, can be effected by adding about 1 to 2 mole equivalent of the aforesaid 2,2-disubstituted-2-amino-1-alkanol per mole equivalent of the dicarboxylic acid material, with or without an inert diluent, and heating the mixture at 140°–240° C. optimally 170°–210° C. and preferably 180°–205° C. for ½ to 24, more usually 2 to 8 hours in the presence of 0.01 to 10 wt. % metal salt promoter such as zinc acetate; preferably from about 0.01 to 2 weight percent.

Inert solvents which may be used in the above reaction include hydrocarbon oils, e.g., mineral lubricating oil, kerosene, neutral mineral oils, xylene, halogenated hydrocarbons, e.g., carbon tetrachloride, dichlorobenzene, tetrahydrofuran, etc. Preferably, no solvent is employed.

Completion of the oxazoline reaction can be readily ascertained by using periodic infrared spectral analysis for following oxazoline formation (oxazoline peak forms at 6.0 microns), or by the cessation of water evolution.

METAL SALT PROMOTERS

Metal salts that may be used as promoters in the invention include carboxylic acid salts of Zn, Co, Mn, Ni and Fe. Metal salts from strong acids (HCl, sulfonic acids, $H_2SO_4$, HNO, etc.) and bases tend to diminish the yield of the oxazoline products and instead favor imide or ester formation. For this reason, these strong acid salts or basic salts are not preferred and usually will be avoided. The carboxylic acids used to prepare the desired promoters include $C_1$ to $C_{18}$, e.g., $C_1$ to $C_8$ acids, such as the saturated or unsaturated mono-and dicarboxylic aliphatic hydrocarbon acids, particularly fatty acids. Specific examples of such desired carboxylic acid salts include zinc acetate, zinc formate, zinc propionate, zinc stearate, manganese (ous) acetate, iron tartarate, cobalt (ous) acetate, nickel acetate, etc. Zinc salts such as zinc acetate and zinc oxide, are preferred. Metal salts include the oxides.

The presence of small amounts, such as 0.01 to 10 wt. %, preferably 0.1 to 6 wt. % based on the weight of the reactants, of the metal salt promoter in the reaction mixture has been found to shorten the reaction times and effect complete reaction. It is preferred that the metal salt promoter be present at or near the onset of the reaction for greatest effect. The zinc salt promoter gradually dissolves by forming, inter alia, zinc complexes with the oxazoline product. Significantly and unexpectedly, the presence of zinc in the oxazoline product apparently contributes performance benefits to the oil or gasoline.

REACTION MECHANISM OF THE OXAZOLINE FORMATION

While not known with complete certainty, it is believed that the reaction of the hydrocarbyl substituted dicarboxylic acid material, e.g., a substituted succinic anhydride with the amino alcohol of the invention, e.g., two equivalents of 2,2-disubstituted-2-amino-methanol such as tris-hydroxymethylaminomethane (THAM), gives oxazoline, e.g. bisoxazoline via the intermediacy of several discrete reaction species. If an acid anhydride is used, the initial transformation appears to involve the scission of the anhydride by the amino function of one mole of the amino alcohol to yield an amic acid. Addition of another mole equivalent of amino alcohol is believed to form the amic acid amine salt, which then upon further heating, undergoes cyclodehydration to the final bis-oxazoline product as shown in the equations described below.

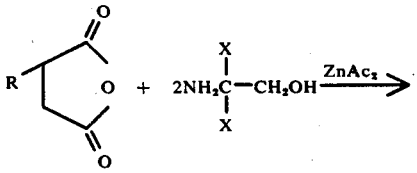

-continued

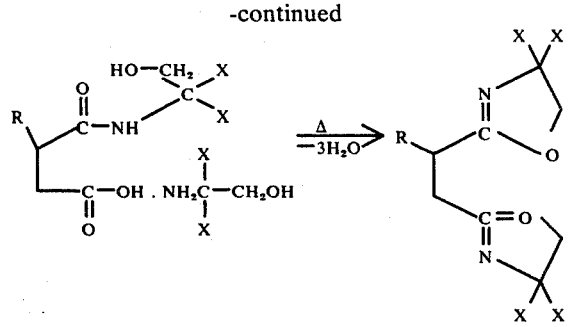

where R is the hydrocarbyl group of the succinic anhydride, and each X in the case of using tris-hydroxymethylaminomethane (THAM) represents a $—CH_2OH$ group.

The promoting effect of metal salts, such as zinc acetate ($ZnAc_2$), on oxazoline formation is very likely ascribable to the favorable polarization of the amide group by the zinc salt towards attack by the hydroxy function of the amino alcohol reactant. It is believed that the dissolved zinc salt ultimately coordinates with the oxazoline ring.

The zinc promoted condensation of about 1 mole equivalent of 2,2-disubstituted-2-amino-1-alkanol per mole equivalent of said dicarboxylic acid material affords a monooxazoline ester, wherein the zinc can also effectively complex with the oxazoline ring.

USE OF THE ZINC-CONTAINING OXAZOLINE REACTION PRODUCT

The zinc-containing oxazoline reaction products formed according to this invention represent a substantial and unexpected improvement of the dispersant properties of lubricants and can be incorporated in a wide variety of oleaginous compositions. They can be used in lubricating oil compositions, such as automotive crankcase lubricating oils, automatic transmission fluids, etc. in petroleum fuels such as gasoline, kerosene, diesel fuels, No. 2 fuel oil, other middle distillates, etc.; and, as an antifoulant in oil streams in refinery operations to prevent fouling of process equipment such as heat exchangers or in turbine oils.

EXAMPLE 1

A mixture of 500 gm. (0.4 moles) of polyisobutenylsuccinic anhydride having a Saponification No. of 89, 500 ml. of tetrahydrofuran (THF) as solvent, 4 gm. of zinc acetate dihydrate ($ZnAc \cdot 2H_2O$) as a promoter and 96.8 gm. (0.8 mole) of THAM was charged into a glass reactor fitted with thermometer, stirrer and a Deane-Starke moisture trap, and heated. When the reaction temperature had risen to 72° C., the THF solvent distilled off. Further heating at about 200° C. for 4 hours gave the expected quantity of water, i.e., about 1.1 moles of water in the trap. After filtration, the reaction product analyzed for 1.99 wt. % nitrogen, and 0.12 wt. % zinc. The product was drawn from the flask and diluted with an equal weight of the Solvent 150 Neutral mineral lubricating oil (S-150N).

The polyisobutenylsuccinic anhydride used as in Examples 1–3 was prepared by conventional technique, namely the reaction of chlorinated polyisobutylene having a chlorine content of about 3.8 wt. %, based on the weight of chlorinated polyisobutylene, and an average of 70 carbom atoms in the polyisobutylene group, with maleic anhydride at about 200° C.

EXAMPLE 2

A mixture of 500 gm. (0.4 moles) of the polyisobutenylsuccinic anhydride of Example 1, 96.8 gm. (0.8 moles) of (THAM) and 4.0 gms. of zinc acetate dihydrate were charged into the glass reactor previously described. The mixture was heated in the oil bath at about 200°–220° C. for about three hours, until water ceased to evolve from the reactor. Approximately 18.0 gm. (1 mole) of water collected in the trap. The infrared spectrum of the reaction product drawn from the flask showed a strong absorption band at 6.0 microns showing the oxazoline structure had formed. Elemental analysis showed that the final product of 50 wt. % of the reaction product dissolved in 50 wt. % Solvent 150 Neutral oil, contained 1.08% nitrogen and 0.058% zinc.

EXAMPLE 3

A 2146 g. sample of polyisobutenylsuccinic anhydride (PIBSA) (Sap. No. 85) was stripped at 220° C. with nitrogen purging, and 31.4 g of light ends were collected. A sample of the stripped PIBSA weighing 2033 g. (1.525 moles) was then heated to about 150° C. and 369 g. (3.05 moles) of THAM plus 28.88 g. ZnO were added. The temperature climbed to 200° C. in an hour, and was maintained at 205° C. for an additional 1½ hours. The product was diluted with an equal weight of S-150N plus three volumes of heptane and filtered. After rotoevaporation, the concentrate (50 weight percent active ingredient) analyzed for 1.07% N and 0.46% Zn.

EXAMPLE 4

In the same manner as Example 3, 1.5 moles (1920 g.) of thermal polyisobutylenesuccinic anhydride (Sap. No. 88) were heated to 140° C. and three moles (363 g.) of THAM plus 13.77 g. of ZnO were added. After complete reaction (as assessed by IR analyses), the product was diluted with S-150N and hexane, and finally filtered. Rotoevaporation afforded a product which analyzed for 0.95% N and 0.26% Zn.

The thermal polyisobutenylsuccinic anhydride was produced by the condensation of 1500 g. of polyisobutylene having a $M_w$ of about 1000 with 188 g. of maleic anhydride in the presence of 5.7 g. of $ZnAc \cdot 2H_2O$ in a pressure reactor under 100 psi for about four hours at 229° C. The product was diluted with heptane, filtered and recovered by rotoevaporation.

EXAMPLE 5

In the manner of Example 4, 1.25 moles (1600 g.) of the above-described thermal PIBSA (Sap. No. 88) were heated to 150° C. and 2.5 moles (302.5 g) of THAM plus 756 g $ZnAc_2 \cdot 2H_2O$ were added. The mixture was kept at 198° C. for about 2 hours and diluted with an equal weight of S-150N. These products from Examples 4 and 5 appear to be virtually imide free judging from infra-red spectroscopic analyses.

EXAMPLE 6

The promoters of the invention by their presence in the reaction environment shorten the reaction time to realize optimal conversion to the oxazoline structure. The time required for optimal conversion can be conveniently assessed by infrared analysis of the reaction mixture at half-hour intervals. Basically, one observes the gradual disappearance of the ester and imide absorption bands at about 5.75 and 5.90 microns. Synchronous with this event, is the appearance of a C=N stretching band at 6.0 microns; the oxazoline band gradually intensifies and eventually becomes the dominating absorption band in the spectrum. Concurrent with the infrared analyses (or alternatively) measurement of the water evolved from the reaction vessel can be measured. This latter approach is used to demonstrate the utility of this invention as will be apparent from the following Table I.

TABLE I

PROMOTING EFFECT OF ZINC ACETATE ON OXAZOLINE FORMATION[a] AS MEASURED BY WATER EVOLUTION

| Zn conc. (wt.%)* | Total** $H_2O$ (ml) Expected | Time: (Min.) | $H_2O$ (ml) Collected 15 | 30 | 45 | 60 | 75 | 90 | % Theory after 30 Mins. |
|---|---|---|---|---|---|---|---|---|---|
| 0 | 13.5 | | 2 | 5 | 8 | 9 | 9 | 10 | 35 |
| 0.1 | 13.9 | | 3 | 7 | 9.5 | 11 | 11 | 12 | 50 |
| 0.5 | 15.7 | | 4 | 8.5 | 10 | 11.5 | 12.5 | 13.5 | 54 |
| 1.0 | 17.9 | | 7 | 13 | 15 | 16 | 16.5 | 17 | 73 |
| 2.0 | 22.2 | | 11 | 19 | 21 | 22 | 23 | 23 | 86 |

[a]Reaction is carried out by admixing a 0.25 mol. of polyisobutenylsuccinic anhydride (Sap.No. 84) prepared from 980 $M_w$ polyisobutylene, with 0.5 mol. of THAM and the requisite wt. % of zinc* (derived from zinc acetate dihydrate reagent) at about 180° C. The water is collected from the well stirred reactor in a calibrated Dean Stark moisture trap. The volume of water collected was recorded at 15 minute intervals.
*based on the combined weight of the polyisobutenylauccinic anhydride and THAM
**Calculated from the amount of reactants and Zn $AC_2 \cdot 2\ H_2O$ promoter used in the reaction.

Sludge Inhibition Bench (SIB) Test

The product of Examples 2 and 5 and two other dispersant additives were subjected to a Sludge Inhibition Bench (SIB) Test which has been found after a large number of evaluations, to be an excellent test for assessing the dispersing power of lubricating oil dispersant additives.

The medium chosen for the Sludge Inhibition Bench Test was a used crankcase mineral lubricating oil composition having an original viscosity of about 325 SUS at 100° F. that had been used in a taxicab that was driven generally for short trips only, thereby causing a buildup of a high concentration of sludge precursors. The oil that was used contained only a refined base mineral lubricating oil, a viscosity index improver, a pour point depressant and zinc dialkyldithiophosphate antiwear additive. The oil contained no sludge dispersants. A quantity of such used oil was acquired by draining and refilling the taxicab crankcase at 1000–2000 mile intervals.

The Sludge Inhibition Bench Test is conducted in the following manner. The aforesaid used crankcase oil, which is milky brown in color, is freed of sludge by centifuging for ½ hour at about 39,000 gravities (gs.). The rusulting clear bright red supernatant oil is then decanted from the insoluble sludge particles thereby separated out. However, the supernatant oil still contains oil-soluble sludge precursors which on heating under the conditions employed by this test will tend to form additional oil-insoluble deposits of sludge. The sludge inhibiting properties of the additives being tested are determined by adding to portions of the supernatant used oil, a small amount, such as 0.5, 0.8 or 1.2 weight percent, on an active ingredient basis, of the particular additive being tested. Ten grams of each blend being tested is placed in a stainless steel centrifuge tube and is heated at 280° F. for 16 hours in the presence of air. Following the heating, the tube containing the oil being tested is cooled and then centrifuged for 30 minutes at about 39,000 gs. Any deposits of new sludge that form in this step are separated from the oil by decanting the supernatant oil and then carefully washing the sludge deposits with 15 ml. of pentane to remove all remaining oil from the sludge. Then the weight of the new solid sludge that has been formed in the test, in milligrams, is determined by drying the residue and weighing it. The results are reported as milligrams of sludge per 10 grams of oil, thus measuring differences as small as 1 part per 10,000. The less new sludge formed the more effective is the additive as a sludge dispersant. In other words, if the additive is effective, it will hold at least a portion of the new sludge that forms on heating and oxidation, stably suspended in the oil so it does not precipitate down during the centrifuging.

Using the above-described test, the dispersant action of the zinc-containing oxazoline additives of the present invention was compared with the dispersing power of a commercial dispersant referred to as PIBSA/-TEPA. The PIBSA/TEPA was prepared by reaction of 1 mole of tetraethylene pentamine with 1.5 moles of polyisobutenylsuccinic anhydride (Sap. No. ≈80) obtained from polyisobutylene of about 1000 number average molecular weight. The PIBSA/TEPA dispersant was used in the form of an additive concentrate containing about 50 weight percent PIBSA/TEPA in 50 wt. % mineral lubricating oil. This PIBSA/TEPA additive concentrate analyzed about 1.8% nitrogen, indicating that the active ingredient, i.e., PIBSA/TEPA per se, contained about 3.6% nitrogen.

In addition, the zinc-containing oxazoline products of the present invention were also compared with a Shell dispersant (reported in Example I of British Pat. No. 984,409) in the Sludge Inhibition Bench Test. The Shell dispersant was prepared via the acylation of tris-(hydroxymethyl)aminomethane with polyisobutenylsuccinic anhydride according to the procedure, stoichiometry and reaction conditions specified in Example I of this patent. The test results are given in Table II.

TABLE II

SLUDGE DISPERSANCY TEST RESULTS

| Additive | Mg Sludge/10 g. Oil at 0.5 wt.% | 0.8 wt.% | 1.2 wt.% |
|---|---|---|---|
| of Example 2 | 5.43 | 1.85 | 0.99 |
| of Example 4 | 3.44 | 1.54 | 0.68 |
| Shell Dispersant | 8.01 | 7.10 | 4.48 |
| PIBSA/TEPA | 6.75 | 1.94 | 1.35 |

It will be noted from Table II that both the dispersants of the invention were more effective than the commercial dispersant PIBSA/TEPA and the Shell dispersant prepared according to Example 1 described in Shell's British Pat. No. 984,409. Of the two dispersants of the invention that enriched with zinc to 0.26 wt. % (Example 4) was more effective than that having zinc enrichment of 0.058 wt. % (Example 2).

The metal containing reaction products of the invention which are primarily useful as an antirust additive and/or detergent for gasoline will generally have hydrocarbyl substituents numbering from about 12 to about 49 carbons; whereas, for the applications as a dispersent or detergent in lubricants it is preferred that the hydrocarbyl substituents number from at least about 50 to about 200 carbons.

It is to be understood that the examples present in the foregoing specification are merely illustrative of this invention and are not intended to limit it in any manner, nor is the invention to be limited by any theory regarding its operability. The scope of the invention is to be determined by the appended claims.

The concentration of the metal in the reaction product usefully ranges from about 0.01 to 6 wt. %, preferably from about 0.1 to 2 wt. %; based on the total weight of the reaction product.

What is claimed is:

1. In a process for preparing oxazoline compounds wherein one molar equivalent of an alkenyl substituted succinic acid or alkenyl substituted succinic acid anhydride is reacted with one to two molar equivalents of a 2,2-di-substituted -2-amino-1-alkanol having 2 to 3 hydroxy groups and containing a total of 4 to 8 carbon atoms and represented by the formula:

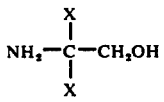

wherein X is an alkyl or hydroxy alkyl group and one of the X substituents being a hydroxyalkyl group of the structure $-(CH_2)_nOH$ wherein $n$ is 1 to 3 at a temperature of from 140° to 240° C., the improvement which comprises conducting said reaction in the presence of from 0.01 to 10 wt. % based on the combined total weight of said reactants of a metal salt promotor of the class of a metal salt of a $C_{1-8}$ hydrocarbyl carboxylic acid or metal oxide whereby said reaction time is shortened, said metal being of the class consisting of zinc, manganese, iron, cobalt and nickel.

2. The process according to claim 1 wherein said metal carboxylate salt consists of metal salts of $C_1$ to $C_8$ fatty acids and said amino-alkanol is present in about two molar equivalents.

3. The process according to claim 2 wherein said salt is zinc acetate or zinc oxide, said amino alkanol is trishydroxy-aminomethane and said temperature is from 170-210° C.

4. An oil soluble reaction product having a weight average molecular weight of from about 200 to 5000 obtained from the reaction of one molar equivalent of an alkenyl substituted succinic acid or alkenyl substituted succinic acid anhydride with from one to two molar equivalents of a 2,2-disubstituted-2-amino-1-alkanol having 2 to 3 hydroxy groups and containing a total of 4 to 8 carbon atoms and represented by the formula:

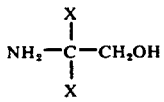

wherein X is an alkyl or hydroxy alkyl group and one of the X substituents being a hydroxyalkyl group of the structure $-(CH_2)_nOH$ wherein $n$ is 1 to 3 at a temperature of from 140° to 240° C., said reaction product containing from about 0.01 to 6 wt. % metal of the class consisting of zinc, manganese, iron, cobalt and nickel, said metal present as a metal salt of a $C_{1-8}$ hydrocarbyl carboxylic acid.

5. The reaction product of claim 4 wherein said metal is zinc and is present in the amounts of from about 0.1 to 2 wt. %.

6. An oil soluble reaction product according to claim 4 wherein one molar proportion of said acid material is reacted with about two molar proportions of trishydroxy-aminomethane whereby a bis-oxazoline reaction product complexed with a metal salt is obtained.

7. A reaction product according to claim 4 wherein said product is substantially imide free and at least 70% of its carboxyl groups have been converted to oxazoline groups.

8. A mono-oxazoline reaction product having a weight average molecular weight of from about 500 to about 3000 obtained from the reaction of one molar proportion of an alkenyl substituted succinic acid or alkenyl substituted succinic acid anhydride and one molar proportion of a 2,2-disubstituted-2-amino-1-alkanol having 2 to 3 hydroxy groups and containing a total of 4 to 8 carbon atoms and represented by the formula:

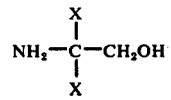

wherein X is an alkyl or hydroxy alkyl group and one of the X substituents being a hydroxy alkyl group of the structure $-(CH_2)_nOH$ wherein $n$ is 1 to 3 at a temperature of from 140° to 240° C. and containing from about 0.1 to 2 wt. % of metal of the class consisting of zinc, iron, cobalt and nickel, said metal present as a salt of a $C_{1-8}$ hydrocarbyl carboxylic acid.

9. An oleaginous composition comprising a major amount of an oil of lubricating viscosity and at least a dispersant amount of an oil soluble oxazoline reaction product having a weight average molecular weight of from about 200 to 5000 obtained from the reaction of about one molar equivalent of an alkenyl substituted succinic acid or alkenyl substituted succinic anhydride reacted with from about one to two molar equivalents of a 2,2-disubstituted-2-amino-1 -alkanol having 2 to 3 hydroxy groups and containing a total of 4 to 8 carbon atoms and represented by the formula:

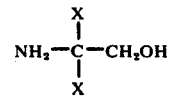

wherein X is an alkyl or hydroxy alkyl group and one of the X substituents being a hydroxyalkyl group of the structure $-(CH_2)_nOH$ wherein $n$ is 1 to 3 at a temperature of from 140° C. to 240° C., said reaction product containing from about 0.01 to 6 wt. % metal of the class consisting of zinc, manganese, iron, cobalt and nickel, said metal present as a metal salt of a $C_{1-8}$ hydrocarbyl carboxylic acid.

10. A composition according to claim 9 wherein said product is a bis-oxazoline reaction product and said metal is zinc and is complexed with said product.

* * * * *

UNITED STATES PATENT OFFICE

CERTIFICATE OF CORRECTION

Patent No. 4,035,309 Dated July 12, 1977

Inventor(s) Stanley J. Brois

It is certified that error appears in the above-identified patent and that said Letters Patent are hereby corrected as shown below:

Column 2, line 46, "$(M_n)$" should read --$(\overline{M}_n)$--.

Column 5, the bisoxazoline product formula should read

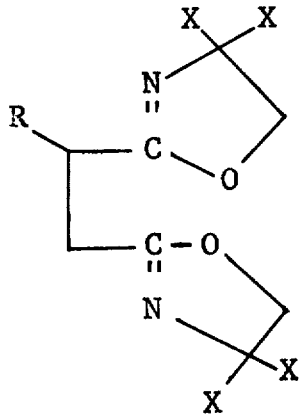

Column 6, line 47, "$M_w$" should read -- $\overline{M}_w$ --.

Signed and Sealed this

Sixth Day of December 1977

[SEAL]

Attest:

RUTH C. MASON
Attesting Officer

LUTRELLE F. PARKER
Acting Commissioner of Patents and Trademarks